US009280953B2

(12) United States Patent
Liao et al.

(10) Patent No.: US 9,280,953 B2
(45) Date of Patent: Mar. 8, 2016

(54) DISPLAY PANEL

(71) Applicant: Chunghwa Picture Tubes, Ltd., Taoyuan (TW)

(72) Inventors: Tzu-Chiang Liao, Taoyuan County (TW); Chih-Wen Lai, Nantou County (TW)

(73) Assignee: Chunghwa Picture Tubes, Ltd., Longtan Dist., Taoyuan (TW)

( * ) Notice: Subject to any disclaimer, the term of this patent is extended or adjusted under 35 U.S.C. 154(b) by 147 days.

(21) Appl. No.: 14/303,619

(22) Filed: Jun. 13, 2014

(65) Prior Publication Data

US 2015/0269910 A1 Sep. 24, 2015

(30) Foreign Application Priority Data

Mar. 21, 2014 (TW) ..... 103204932 U

(51) Int. Cl.

| | |
|---|---|
| ***G09G 5/00*** | (2006.01) |
| ***G09G 5/18*** | (2006.01) |
| ***G09G 3/36*** | (2006.01) |

(52) U.S. Cl.

CPC ..... *G09G 5/18* (2013.01); *G09G 3/3611* (2013.01); *G09G 2300/0421* (2013.01); *G09G 2320/0223* (2013.01)

(58) Field of Classification Search

None

See application file for complete search history.

(56) References Cited

U.S. PATENT DOCUMENTS

2007/0063935 A1* 3/2007 Yoshida ..... G09G 3/325 345/76

* cited by examiner

*Primary Examiner* — Adam R Giesy

(74) *Attorney, Agent, or Firm* — Winston Hsu; Scott Margo

(57) ABSTRACT

A display panel includes a plurality of rows of pixels, a gate driving circuit, and an inspection circuit. The gate driving circuit includes a plurality of gate driving units. The inspection circuit includes a plurality of transistors. Each transistor includes a first terminal, a control terminal, and a second terminal. The first terminal of the transistor is coupled to a contact pad. The control terminal of the transistor is coupled to the corresponding gate driving unit and a corresponding row of pixels. The second terminal of the transistor is coupled to the control terminal of the transistor.

15 Claims, 2 Drawing Sheets

DISPLAY PANEL

BACKGROUND OF THE INVENTION

1. Field of the Invention

The present invention illustrates a display panel, and more particularly, the display panel having the capability for detect failed stages of the gate driving circuit.

2. Description of the Prior Art

With the advancement of the liquid crystal display (LCD), several multi-functional and convenient LCD screens are developed and widely applied to various electronic devices in recent years, such as televisions, mobile phones, tablets, etc. Generally, an LCD device includes a gate driving circuit. The gate driving circuit outputs the scan signal to the corresponding gate line for enabling the pixels coupled to the gate line. To reduce the volume of the display and improve the display efficiency, a gate in panel (GIP) technique is further developed. The main idea of GIP technique is to integrate the gate driving circuit on the array fabricated board instead of using a driving chip to realize the driving circuit in a conventional LCD device. The array fabricated board can be a circuit board with a glass material or even a bendable material. Like the driving method of the conventional LCD device, in GIP circuit, the scan signals sequentially output different voltage amplitudes (i.e., high or low voltage amplitude) to the corresponding gate lines according to a clock signal for enabling a plurality of pixels of the display panel.

However, since the gate driving circuit includes a plurality of stages of gate driving unit and each stage of the gate driving unit outputs the scan signal to the gate line according to the scan signal produced by the previous stage of gate driving unit, all scan signals produced by the gate driving units have causality properties. This means that when N stages of a gate driving unit are used in the gate driving circuit and the $n^{th}$ stage of the gate driving unit has failed, all the scan signals produced by $n^{th}$ to $N^{th}$ are involved to error signal waveforms while decreasing the image display quality. Thus, an appropriate inspection circuit used to detect the scan signals in the gate driving circuit for identifying the failed stage of gate driving unit is an important device to improve the image display quality.

SUMMARY OF THE INVENTION

According to the claimed invention, a display panel includes a plurality of rows of pixels, agate driving circuit, a source driving circuit, and an inspection circuit. Each row of pixels includes a plurality of pixels. The gate driving circuit includes a plurality of gate driving units. Each gate driving unit outputs a scan single for enabling the corresponding row of pixels. The source driving circuit is coupled to the plurality of pixels for transmitting data signals to the plurality of pixels. The inspection circuit includes a plurality of transistors. Each transistor includes a first terminal coupled to a test pad, a control terminal coupled to the corresponding gate driving unit and the corresponding row of pixels, and a second terminal coupled to the control terminal of the transistor. When the gate driving unit outputs the scan signal, the scan signal enables the transistor so that the transistor can transmit the scan signal to the test pad for determining whether the gate driving unit outputs the correct scan signal or not.

According to the claimed invention, another display panel includes a plurality of rows of pixels, a first gate driving circuit, a second gate driving circuit, a source driving circuit, a first inspection circuit, and a second inspection circuit. Each row of pixels includes a plurality of pixels. The first gate driving circuit includes a plurality of first gate driving units. Each first gate driving unit outputs a first scan single for enabling the row of pixels coupled to the first gate driving unit. The second gate driving circuit includes a plurality of second gate driving units. Each second gate driving unit outputs a second scan single for enabling the row of pixels coupled to the second gate driving unit. The source driving circuit is coupled to the plurality of pixels for transmitting data signals to the plurality of pixels. The first inspection circuit includes a plurality of first transistors. Each first transistor includes a first terminal coupled to a first test pad, a control terminal coupled to the corresponding first gate driving unit, and a second terminal coupled to the control terminal of the first transistor. The second inspection circuit includes a plurality of second transistors. Each second transistor includes a first terminal coupled to a second test pad, a control terminal coupled to the corresponding second gate driving unit, and a second terminal coupled to the control terminal of the second transistor. When the first gate driving unit outputs the first scan signal, the first scan signal enables the first transistor so that the first transistor can transmit the first scan signal to the first test pad for determining whether the first gate driving unit outputs the correct first scan signal or not. When the second gate driving unit outputs the second scan signal, the second scan signal enables the second transistor so that the second transistor can transmit the second scan signal to the second test pad for determining whether the second gate driving unit outputs the correct second scan signal or not.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
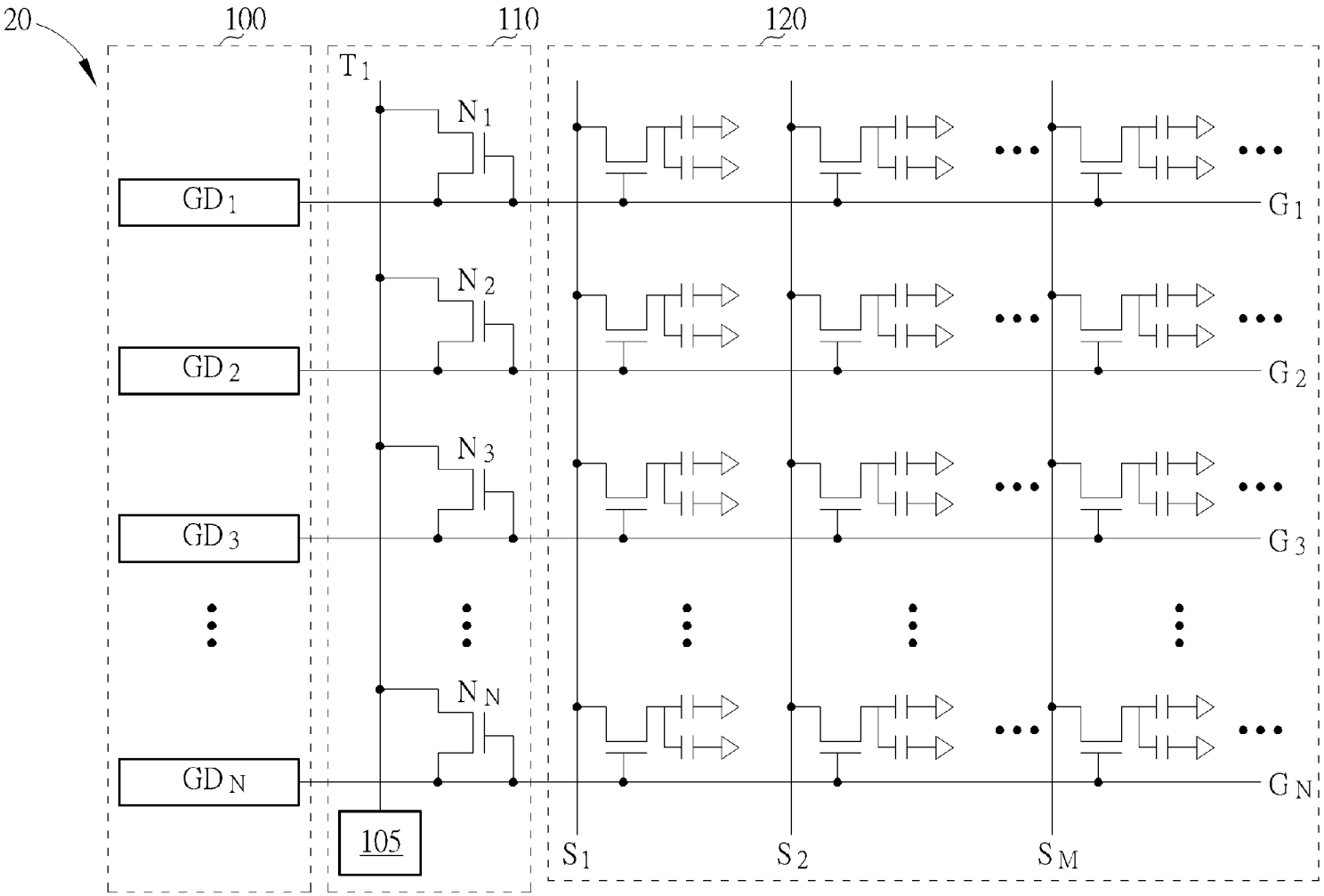
FIG. 1 is a schematic circuit structure of display panel according to the first embodiment of the present invention.

Please refer to FIG. 1. FIG. 1 is a schematic circuit structure of display panel according to the first embodiment of the present invention. As shown in FIG. 1, a display panel 20 includes a gate driving circuit 100, an inspection circuit 110 and a pixel array 120. The gate driving circuit 100 includes a plurality of gate driving units $GD_1$ to $GD_N$, where the plurality of gate driving units $GD_1$ to $GD_N$ are respectively coupled to a plurality of gate lines $G_1$ to $G_N$. N is a positive integer. The plurality of gate lines $G_1$ to $G_N$ is respectively coupled to the $1^{st}$ rows of pixels to the $N^{th}$ rows of pixels for controlling the enabled/disabled operation. The plurality of gate driving units $GD_1$ to $GD_N$ sequentially output the scan signals with different voltage amplitudes (i.e., high or low voltage amplitude) to the plurality of corresponding gate lines $G_1$ to $G_N$ according to a clock signal. The inspection circuit 110 includes a test line $T_1$, a plurality of transistors $N_1$ to $N_N$, and a test pad 105. In particular, when the scan signal is used for enabling the plurality of pixels, the voltage intensity of the scan signal degrades with the transmission distance. To achieve the best inspection quality, the inspection circuit is located between the gate driving circuit 100 and the plurality of rows of pixels to detect the original (i.e., no degradation) scan signal.

In the inspection circuit 110, the plurality of transistors $N_1$ to $N_N$ can be a plurality of N-type metal-oxide-semiconductor field-effect transistors (N-type MOSFET). Each transistor $N_1$ to $N_N$ includes a first terminal, a control terminal, and a second terminal. The first terminal is coupled to the test line $T_1$. The control terminal is coupled to the gate line $G_1$ to $G_N$ with respect to the corresponding gate driving unit $GD_1$ to $GD_N$. The second terminal is coupled to the control terminal of the transistor $N_1$ to $N_N$. The test pad 105 is coupled to a terminal of the test line $T_1$.

In other words, in this embodiment, the first terminal of the transistor $N_1$ is coupled to the test line $T_1$. The second terminal and the control terminal of the transistor $N_1$ is coupled to the $1^{st}$ gate line $G_1$. The first terminal of the transistor $N_2$ is coupled to the test line $T_1$. The second terminal and the control terminal of the transistor $N_2$ is coupled to the $2^{nd}$ gate line $G_2$. The first terminal of the transistor $N_3$ is coupled to the test line $T_1$. The second terminal and the control terminal of the transistor $N_3$ is coupled to the $3^{rd}$ gate line $G_3$. And so on, the first terminal of the transistor $N_N$ is coupled to the test line $T_1$. The second terminal and the control terminal of the transistor $N_N$ is coupled to the $n^{th}$ gate line $G_N$.

In this embodiment, the pixel array 120 is considered as an N×M pixel array, where M is a positive integer. The plurality of pixels of the pixel array 120 are operated by using N gate lines $G_1$ to $G_N$ and M data lines $S_1$ to $S_M$. When the display panel 20 displays the image, the plurality of gate driving units $GD_1$ to $GD_N$ sequentially transmit the scan signals to the corresponding plurality of gate lines $G_1$ to $G_N$ for sequentially enabling the $1^{st}$ rows of the pixels to the $N^{th}$ rows of the pixels in the pixel array 120. Then, the image data can be transmitted to the pixels according to the corresponding data lines $S_1$ to $S_M$.

For example, the $1^{st}$ gate driving unit $GD_1$ produces a high voltage scan signal with unit width of the clock signal waveform in the $1^{st}$ timing interval of the clock signal and transmits the high voltage scan signal to the $1^{st}$ gate line $G_1$ for enabling the $1^{st}$ row of pixels corresponding to the $1^{st}$ gate line $G_1$ in the pixel array 120. The $2^{nd}$ gate driving unit $GD_2$ produces a high voltage scan signal with unit width of the clock signal waveform in the $2^{nd}$ timing interval of the clock signal and transmits the high voltage scan signal to the $2^{nd}$ gate line $G_2$ for enabling the $2^{nd}$ row of pixels corresponding to the $2^{nd}$ gate line $G_2$ in the pixel array 120. The $3^{rd}$ gate driving unit $GD_3$ produces a high voltage scan signal with unit width of the clock signal waveform in the $3^{rd}$ timing interval of the clock signal and transmits the high voltage scan signal to the $3^{rd}$ gate line $G_3$ for enabling the $3^{rd}$ row of pixels corresponding to the $3^{rd}$ gate line $G_3$ in the pixel array 120. And so on, the $N^{th}$ gate driving unit $GD_N$ produces a high voltage scan signal with unit width of the clock signal waveform in the $N^{th}$ timing interval of the clock signal and transmits the high voltage scan signal to the $N^{th}$ gate line $G_N$ for enabling the $N^{th}$ row of pixels corresponding to the $N^{th}$ gate line $G_N$ in the pixel array 120.

Specifically, the scan signals are sequentially produced by the plurality of gate driving units $GD_1$ to $GD_N$. A positive delay timing interval exists between the falling edge of the scan signal outputted by the former stage and the rising edge of the scan signal outputted by the latter stage of the gate driving unit. Such positive delay timing interval is equal or greater than the resistor-capacitor delay (RC delay) and can avoid the pulses overlapping effect of the scan signals in adjacent timing intervals. By using the positive delay timing interval to eliminate the interference caused by the pulses overlapping, the image display quality can be improved. When the plurality of gate driving units $GD_1$ to $GD_N$ respectively produce the high voltage scan signals, since the control terminal and the second terminal of the plurality of transistors $N_1$ to $N_N$ in the inspection circuit 100 are respectively coupled to the plurality of gate lines $G_1$ to $G_N$, the high voltage scan signal enables the corresponding transistor. Thus, the high voltage scan signal can be further transmitted from the second terminal of the enabled transistor to the test line $T_1$ coupled to the first terminal of the enabled transistor.

This means that when the $1^{st}$ gate line $G_1$ carries a high voltage scan signal, the transistor $N_1$ is enabled and the high voltage scan signal can be transmitted to the test line $T_1$ through the transistor $N_1$. When the $2^{nd}$ gate line $G_2$ carries a high voltage scan signal, the transistor $N_2$ is enabled and the high voltage scan signal can be transmitted to the test line $T_1$ through the transistor $N_2$. When the $3^{rd}$ gate line $G_3$ carries a high voltage scan signal, the transistor $N_3$ is enabled and the high voltage scan signal can be transmitted to the test line $T_1$ through the transistor $N_3$. And so on, when the $N^{th}$ gate line $G_N$ carries a high voltage scan signal, the transistor $N_N$ is enabled and the high voltage scan signal can be transmitted to the test line $T_1$ through the transistor $N_N$.

Since the test pad 105 is coupled to the test line $T_1$, by observing the scan signal on the test pad 105 in each timing interval, the error waveform of the scan signal and the corresponding failed stage of the gate driving unit can be identified. For instance, when the $K^{th}$ gate driving unit $GD_K$ is inspected, by observing the scan signal on the test pad 105 in the $K^{th}$ timing interval, if the signal waveform of the scan signal in the $K^{th}$ timing interval shows error (i.e., The error signal waveform includes the amplitude of signal wave being in error or the pulse width of signal wave being in error), the $K^{th}$ gate driving unit $GD_K$ can be identified as the failed stage of the gate driving unit.

Figure 2:
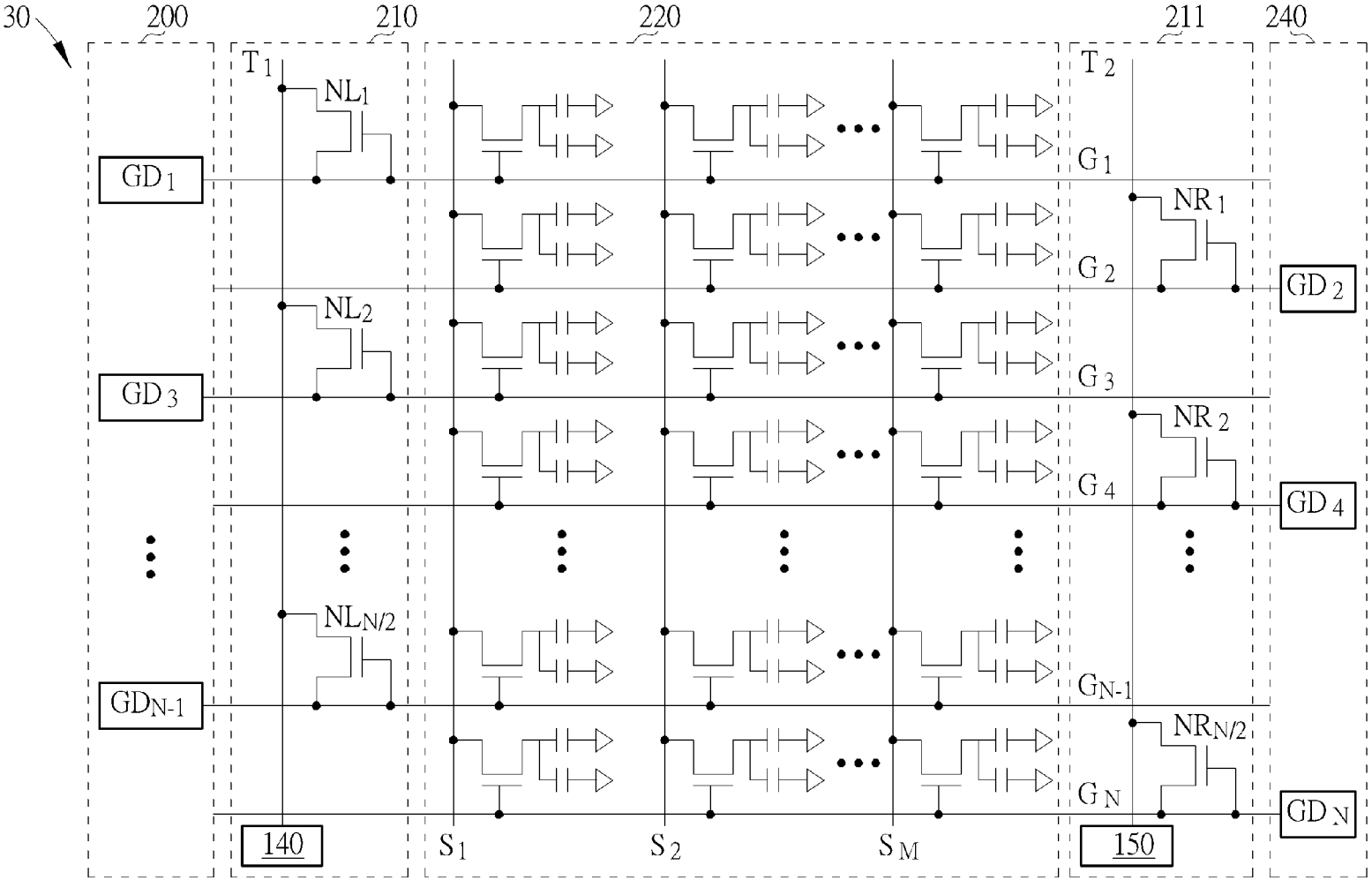
FIG. 2 is a schematic circuit structure of display panel according to the second embodiment of the present invention.

Please refer to FIG. 2. FIG. 2 is a schematic circuit structure of display panel according to the second embodiment of the present invention. As shown in FIG. 2, a display panel 30 includes a first gate driving circuit 200, a second gate driving circuit 240, a first inspection circuit 210, a second inspection circuit 211 and a pixel array 220. The first gate driving circuit 200 and the second gate driving circuit 240 are located on two sides of the pixel array 220. The first gate driving circuit 200 includes a plurality of odd-ordered gate driving units $GD_1$, $GD_3$, $GD_5$, . . . , $GD_{N-1}$. The second gate driving circuit 240 includes a plurality of even-ordered gate driving units $GD_2$, $GD_4$, $GD_6$, . . . , $GD_N$. In this embodiment, N is a positive integer and N is even. The plurality of odd-ordered gate driving units $GD_1$, $GD_3$, $GD_5$, . . . , $GD_{N-1}$ is respectively coupled to the plurality of odd-ordered gate lines $G_1$, $G_3$, $G_5$, . . . , $G_{N-1}$ and is respectively coupled to the $1^{st}$, $3^{rd}$, $5^{th}$, . . . , $N-1^{th}$ rows of pixels on the pixel array 220 for controlling the operational mode. The plurality of even-ordered gate driving units $GD_2$, $GD_4$, $GD_6$, . . . , $GD_N$ is respectively coupled to the plurality of even-ordered gate lines $G_2$, $G_4$, $G_6$, . . . , $G_N$ and is respectively coupled to the $2^{nd}$, $4^{th}$, $6^{th}$, . . . , $N^{th}$ rows of pixels on the pixel array 220 for controlling the operational mode. The odd-ordered gate driving units $GD_1$, $GD_3$, $GD_5$, . . . , $GD_{N-1}$ of the first gate driving circuit 200 respectively output the first scan signals to the gate lines $G_1$, $G_3$, $G_5$, . . . , $G_{N-1}$ in the odd-ordered timing intervals. The even-ordered gate driving units $GD_2$, $GD_4$, $GD_6$, . . . , $GD_N$ of the second gate driving circuit 240 respectively output the second scan signals to the gate lines $G_2$, $G_4$, $G_6$, . . . , $G_N$ in the even-ordered timing intervals. The detailed operation method is illustrated below.

In this embodiment, a first inspection circuit 210 is located between the first gate driving circuit 200 and the pixel array 220. The first inspection circuit 210 includes a first test line $T_1$, a plurality of first transistors $NL_1$, $NL_2$, $NL_3$, . . . $NL_{N/2}$, and a first test pad 140. The plurality of first transistors $NL_1$, $NL_2$, $NL_3$, . . . $NL_{N/2}$, can be a plurality of N-type metal-oxide-semiconductor field-effect transistors (N-type MOSFET). Each first transistor includes a first terminal coupled to the first test line $T_1$, a control terminal coupled to the corresponding odd-ordered gate line of the gate lines $G_1$, $G_3$, $G_5$, . . . , $G_{N-1}$ with respect to the odd-ordered gate driving units $GD_1$, $GD_3$, $GD_5$, . . . , $GD_{N-1}$, and a second terminal coupled to the control terminal of the first transistor. The first test pad 140 is coupled to a terminal of the first test line $T_1$. A second inspection circuit 211 is located between the second gate driving circuit 240 and the pixel array 220. The second inspection circuit 211 includes a second test line $T_2$, a plurality of second transistors $NR_1$, $NR_2$, $NR_3$, . . . , $NR_{N/2}$, and a second test pad 150. The plurality of second transistors $NR_1$, $NR_2$, $NR_3$, . . . , $NR_{N/2}$ can be a plurality of N-type metal-oxide-semiconductor field-effect transistors (N-type MOSFET). Each second transistor includes a first terminal coupled to the second test line $T_2$, a control terminal coupled to the corresponding even-ordered gate line of the gate lines $G_2$, $G_4$, $G_6$, . . . , $G_N$ with respect to the even-ordered gate driving units $GD_2$, $GD_4$, $GD_6$, . . . , $GD_N$, and a second terminal coupled to the control terminal of the second transistor. The second test pad 150 is coupled to a terminal of the second test line $T_2$.

In other words, in this embodiment, the first terminal of the first transistor $NL_1$ is coupled to the first test line $T_1$. The second terminal and the control terminal of the first transistor $NL_1$ are coupled to the $1^{st}$ gate line $G_1$. The first terminal of the first transistor $NL_2$ is coupled to the first test line $T_1$. The second terminal and the control terminal of the first transistor $NL_2$ are coupled to the $3^{rd}$ gate line $G_3$. The first terminal of the first transistor $NL_3$ is coupled to the first test line $T_1$. The second terminal and the control terminal of the first transistor $NL_3$ are coupled to the $5^{th}$ gate line $G_5$. And so on, the first terminal of the first transistor $NL_{N/2}$ is coupled to the first test line $T_1$. The second terminal and the control terminal of the first transistor $NL_{N/2}$ are coupled to the $N-1^{th}$ gate line $G_{N-1}$. In this embodiment, the first terminal of the second transistor $NR_1$ is coupled to the second test line $T_2$. The second terminal and the control terminal of the second transistor $NR_1$ are coupled to the $2^{nd}$ gate line $G_2$. The first terminal of the second transistor $NR_2$ is coupled to the second test line $T_2$. The second terminal and the control terminal of the second transistor $NR_2$ are coupled to the $4^{th}$ gate line $G_4$. The first terminal of the second transistor $NR_3$ is coupled to the second test line $T_2$. The second terminal and the control terminal of the second transistor $NR_3$ are coupled to the $6^{th}$ gate line $G_6$. And so on, the first terminal of the second transistor $NR_{N/2}$ is coupled to the second test line $T_2$. The second terminal and the control terminal of the second transistor $NR_{N/2}$ are coupled to the $N^{th}$ gate line $G_N$.

In this embodiment, the pixel array 220 is considered as an N×M array. The plurality of pixels of the pixel array 220 is operated by using N gate lines $G_1$ to $G_N$ and M data lines $S_1$ to $S_M$. When the display panel 30 displays the image, the plurality of odd-ordered gate driving units $GD_1$, $GD_3$, $GD_5$, . . . , $GD_{N-1}$ in the first gate driving circuit 200 sequentially transmits the odd-ordered scan signals to the corresponding plurality of odd-ordered gate lines $G_1$, $G_3$, $G_5$, . . . , $G_{N-1}$ for sequentially enabling the $1^{st}$, $3^{rd}$, $5^{th}$, . . . , $N-1^{th}$ rows of pixels in the pixel array 220. The plurality of even-ordered gate driving units $GD_2$, $GD_4$, $GD_6$, . . . , $GD_N$ in the second gate driving circuit 240 sequentially transmits the even-ordered scan signals to the corresponding plurality of even-ordered gate lines $G_2$, $G_4$, $G_6$, . . . , $G_N$ for sequentially enabling the $2^{st}$, $4^{th}$, $6^{th}$, . . . $N^{th}$ rows of pixels in the pixel array 220. Then, the image data can be transmitted to the plurality of pixels according to the corresponding data lines $S_1$ to $S_M$.

For example, the $1^{st}$ gate driving unit $GD_1$ in the first gate driving circuit 200 produces a first high voltage scan signal with unit width of the clock signal waveform in the $1^{st}$ timing interval of the clock signal and transmits the first high voltage scan signal to the $1^{st}$ gate line $G_1$ for enabling the $1^{st}$ row of pixels corresponding to the $1^{st}$ gate line $G_1$ in the pixel array 220. The $2^{nd}$ gate driving unit $GD_2$ in the second gate driving circuit 240 produces a second high voltage scan signal with unit width of the clock signal waveform in the $2^{nd}$ timing interval of the clock signal and transmits the second high voltage scan signal to the $2^{nd}$ gate line $G_2$ for enabling the $2^{nd}$ row of pixels corresponding to the $2^{nd}$ gate line $G_2$ in the pixel array 220. The $3^{rd}$ gate driving unit $GD_3$ in the first gate driving circuit 200 produces a first high voltage scan signal with unit width of the clock signal waveform in the $3^{rd}$ timing interval of the clock signal and transmits the first high voltage scan signal to the $3^{rd}$ gate line $G_3$ for enabling the $3^{rd}$ row of pixels corresponding to the $3^{rd}$ gate line $G_3$ in the pixel array 220. The $4^{th}$ gate driving unit $GD_4$ in the second gate driving circuit 240 produces a second high voltage scan signal with unit width of the clock signal waveform in the $4^{th}$ timing interval of the clock signal and transmits the second high voltage scan signal to the $4^{th}$ gate line $G_4$ for enabling the $4^{th}$ row of pixels corresponding to the $4^{th}$ gate line $G_4$ in the pixel array 220. And so on, the $N-1^{th}$ gate driving unit $GD_{N-1}$ in the first gate driving circuit 200 produces a first high voltage scan signal with unit width of the clock signal waveform in the $N-1^{th}$ timing interval of the clock signal and transmits the first high voltage scan signal to the $N-1^{th}$ gate line $G_{N-1}$ for enabling the $N-1^{th}$ row of pixels corresponding to the $N-1^{th}$ gate line $G_{N-1}$ in the pixel array 220. The $N^{th}$ gate driving unit $GD_N$ in the second gate driving circuit 240 produces a second high voltage scan signal with unit width of the clock signal waveform in the $N^{th}$ timing interval of the clock signal and transmits the second high voltage scan signal to the $N^{th}$ gate line $G_N$ for enabling the $N^{th}$ row of pixels corresponding to the $N^{th}$ gate line $G_N$ in the pixel array 220.

Briefly speaking, the first driving circuit 200 respectively produces the first high voltage scan signals and transmits the first high voltage scan signals to the corresponding odd-ordered gate lines according to the odd-ordered timing intervals of the clock signal. The second driving circuit 240 respectively produces the second high voltage scan signals and transmits the second high voltage scan signals to the corresponding even-ordered gate lines according to the even-ordered timing intervals of the clock signal. Specifically, in this embodiment, since the plurality of gate driving units $GD_1$ to $GD_N$ respectively produce the first scan signal and the second scan signal according to the odd-ordered timing intervals and even-ordered timing intervals of the clock signal, no interference (i.e., The interference is caused by pulses overlapping) between the first scan signal and the second scan signal in adjacent intervals occurs, even no RC delay.

When the plurality of gate driving units $GD_1$ to $GD_N$ respectively produce the first high voltage scan signals and the second high voltage scan signals, since the control terminals and the second terminals of the plurality of the first transistors $NL_1$, $NL_2$, $NL_3$, . . . , $NL_{N/2}$ in the first inspection circuit 210 are respectively coupled to the corresponding odd-ordered gate lines $G_1$, $G_3$, $G_5$, . . . , $G_{N-1}$ and the control terminals and the second terminals of the plurality of the second transistors $NR_1$, $NR_2$, $NR_3$, . . . , $NR_{N/2}$ in the second inspection circuit 211 are respectively coupled to the corresponding even-ordered gate lines G2, G4, G6, . . . , GN and the control terminals, the first or the second high voltage scan signals enable the corresponding transistors according to the odd-ordered timing intervals of the clock signal or even-ordered timing intervals of the clock signal. Thus, the high voltage scan signals can be transmitted to the first test line $T_1$ coupled to the first transistors $NL_1, NL_2, NL_3, \ldots, NL_{N/2}$ or the second test line $T_2$ coupled to the second transistors $NR_1, NR_2, NR_3, \ldots, NR_{N/2}$ through the second terminals of the transistors.

This means that when the $1^{st}$ gate line $G_1$ carries the first high voltage scan signal, the first transistor $NL_1$ is enabled and the first high voltage scan signal can be transmitted to the first test line $T_1$ through the first transistor $NL_1$. When the $2^{nd}$ gate line $G_2$ carries the second high voltage scan signal, the second transistor $NR_1$ is enabled so that the second high voltage scan signal can be transmitted to the second test line $T_2$ through the second transistor $NR_1$. When the $3^{rd}$ gate line $G_3$ carries the first high voltage scan signal, the first transistor $NL_2$ is enabled so that the first high voltage scan signal can be transmitted to the first test line $T_1$ through the first transistor $NL_2$. When the $4^{th}$ gate line $G_4$ carries the second high voltage scan signal, the second transistor $NR_2$ is enabled so that the second high voltage scan signal can be transmitted to the second test line $T_2$ through the second transistor $NR_2$. And so on, when the $N-1^{th}$ gate line $G_{N-1}$ carries the first high voltage scan signal, the first transistor $NL_{N/2}$ is enabled so that the first high voltage scan signal can be transmitted to the first test line $T_1$ through the first transistor $NL_{N/2}$. When the $N^{th}$ gate line $G_N$ carries the second high voltage scan signal, the second transistor $NR_{N/2}$ is enabled so that the second high voltage scan signal can be transmitted to the second test line $T_2$ through the second transistor $NR_{N/2}$.

Since the first test pad 140 and the second test pad 150 are respectively coupled to the terminal of the first test line $T_1$ and the terminal of the second test line $T_2$, by observing the first scan signal on the first test pad 140 in each odd-ordered timing interval, the error waveform of the first scan signal and the corresponding odd-ordered failed stage of the gate driving unit can be identified. By observing the second scan signal on the second test pad 150 in each even-ordered timing interval, the error waveform of the second scan signal and the corresponding even-ordered failed stage of the gate driving unit can be identified.

For example, when the $P^{th}$ gate driving unit $GD_P$ is inspected where the positive integer P is odd, by observing the waveform of the first scan signal on the first test pad 140 in the $P^{th}$ timing interval, if the waveform of the first scan signal in the $P^{th}$ timing interval is in error, the $P^{th}$ gate driving unit $GD_P$ can be identified as the failed stage of the gate driving unit . When the $Q^{th}$ gate driving unit $GD_Q$ is inspected where the positive integer Q is even, by observing the waveform of the second scan signal on the second test pad 150 in the $Q^{th}$ timing interval, if the waveform of the second scan signal in the $Q^{th}$ timing interval is in error, the $Q^{th}$ gate driving unit $GD_Q$ can be identified as the failed stage of the gate driving unit.

To sum up the present invention, a display panel having the capability for detecting the failed stages of the gate driving circuit is developed. In the display panel, since the control terminals of the transistors in the inspection circuit are respectively coupled to the gate lines, when the gate line carries a high voltage scan signal, the transistor is enabled. Further, since the second terminals of the transistors are respectively coupled to the gate lines, when the corresponding transistor is enabled, the high voltage scan signal can be transmitted to the test pad coupled to the first terminal of the corresponding transistor. Thus, high voltage scan signal in each timing interval in the display panel can be detected by observing the signal waveform on the test pad. As a result, the display panel of the present invention can inspect the gate driving circuit and can identify the failed stage of the gate driving unit in the gate driving circuit, thereby improving the image display quality.

What is claimed is:

1. A display panel comprising:

a plurality of rows of pixels, each row of pixels including a plurality of pixels;

a first gate driving circuit including a plurality of first gate driving units, each first gate driving unit outputting a first scan signal for driving a row of pixels coupled to the first gate driving unit;

a second gate driving circuit including a plurality of second gate driving units, each second gate driving unit outputting a second scan signal for driving a row of pixels coupled to the second gate driving unit;

a source driving circuit coupled to the plurality of pixels for transmitting data signals to the plurality of pixels;

a first inspection circuit including a plurality of first transistors, each first transistor including:

a first terminal coupled to a first test pad;

a control terminal coupled to a corresponding first gate driving unit; and a second terminal coupled to the control terminal of the first transistor; and a second inspection circuit, including a plurality of second transistors, each second transistor including:

a first terminal coupled to a second test pad;

a control terminal coupled to a corresponding second gate driving unit; and a second terminal coupled to the control terminal of the second transistor;

wherein when the first gate driving unit outputs the first scan signal, the first scan signal enables the first transistor so as to transmit the first scan signal to the first test pad while the first transistor is enabled, and when the second gate driving unit outputs the second scan signal, the second scan signal enables the second transistor so as to transmit the second scan signal to the second test pad while the second transistor is enabled for determining whether the first gate driving unit and the second gate driving unit are able to output the first scan signal and the second scan signal correctly.

2. The display panel of claim 1 wherein the plurality of first transistors and the plurality of second transistors are N-type metal-oxide-semiconductor transistors.

3. The display panel of claim 1 wherein the plurality of first gate driving units are coupled to odd rows of pixels of the plurality of rows of pixels.

4. The display panel of claim 3 wherein the plurality of second gate driving units are coupled to even rows of pixels of the plurality of rows of pixels.

5. The display panel of claim 1 wherein the plurality of second gate driving units are coupled to even rows of pixels of the plurality of rows of pixels.

6. The display panel of claim 1 wherein the first gate driving circuit is disposed at a left side of the plurality of rows of pixels and the second gate driving circuit is disposed at a right side of the plurality of rows of pixels.

7. The display panel of claim 1 wherein the first gate driving circuit is disposed at a right side of the plurality of rows of pixels and the second gate driving circuit is disposed at a left side of the plurality of rows of pixels.

8. The display panel of claim 1 wherein the first inspection circuit is disposed between the first gate driving circuit and the plurality of rows of pixels.

9. The display panel of claim 8 wherein the second inspection circuit is disposed between the second gate driving circuit and the plurality of rows of pixels.

10. The display panel of claim 1 wherein the second inspection circuit is disposed between the second gate driving circuit and the plurality of rows of pixels.

11. A display panel comprising:

a plurality of rows of pixels, each row of pixels including a plurality of pixels;

a gate driving circuit including a plurality of gate driving units, each gate driving unit outputting a scan signal for driving a row of pixels coupled to the gate driving unit;

a source driving circuit coupled to the plurality of pixels for transmitting data signals to the plurality of pixels; and an inspection circuit including a plurality of transistors, each transistor including:

a first terminal coupled to a test pad;

a control terminal coupled to a corresponding gate driving unit and a corresponding row of pixels; and a second terminal coupled to the control terminal of the transistor;

wherein when the gate driving unit outputs the scan signal, the scan signal enables the transistor so as to transmit the scan signal to the test pad for determining whether the gate driving unit is able to output the scan signal correctly.

12. The display panel of claim 11 wherein the plurality of transistors are N-type metal-oxide-semiconductor transistors.

13. The display panel of claim 11 wherein a falling edge of a scan signal leads a rising edge of a following scan signal by a positive time interval.

14. The display panel of claim 13 wherein the positive time interval is greater than a resistor-capacitor delay (RC delay) of the gate driving unit.

15. The display panel of claim 11, wherein the inspection circuit is disposed between the gate driving circuit and the plurality of rows of pixels.

* * * * *